US008175503B2

(12) United States Patent
Kotera et al.

(10) Patent No.: US 8,175,503 B2
(45) Date of Patent: May 8, 2012

(54) DEVELOPING DEVICE AND IMAGE FORMING APPARATUS WITH INTERMEDIATE ROLLER FOR ASSURING EFFICIENT CIRCULATION OF DEVELOPER

(75) Inventors: Asami Kotera, Osaka (JP); Hiroyuki Hamakawa, Osaka (JP)

(73) Assignee: Kyocera Mita Corporation (JP)

( * ) Notice: Subject to any disclaimer, the term of this patent is extended or adjusted under 35 U.S.C. 154(b) by 684 days.

(21) Appl. No.: 12/352,183

(22) Filed: Jan. 12, 2009

(65) Prior Publication Data

US 2009/0185831 A1 Jul. 23, 2009

(30) Foreign Application Priority Data

Jan. 18, 2008 (JP) ..... 2008-008941

(51) Int. Cl.
*G03G 15/08* (2006.01)

(52) U.S. Cl. ..... 399/281; 399/282; 399/283

(58) Field of Classification Search ..... 399/281, 399/282, 283, 272–274
See application file for complete search history.

(56) References Cited

U.S. PATENT DOCUMENTS 4,131,357 A * 12/1978 Forbes, II ..... 399/272

FOREIGN PATENT DOCUMENTS

JP 9-274386 10/1997

* cited by examiner

*Primary Examiner* — David Gray
*Assistant Examiner* — Laura Roth
(74) *Attorney, Agent, or Firm* — Gerald E. Hespos; Michael J. Porco

(57) ABSTRACT

A developing device is provided with a developing roller arranged to face a photoconductor for forming an electrostatic latent image and adapted to supply a toner to the photoconductor, an agitating member for agitating a developer, a supply roller that holds the developer agitated by the agitating member, and supplies the toner to an area facing the developing roller; a restricting member for blocking the developer supplied onto the supply roller and restricting the amount of the developer conveyed by the supply roller, and an intermediate roller including a first magnetic pole facing in a direction toward the staying developer by being restricted by the restricting member for attracting the staying developer and arranged at such a position as to face the developer blocked by the restricting member. Thus, the developing device can avoid image quality deterioration even when a developing process continues over a long period of time.

10 Claims, 4 Drawing Sheets

DEVELOPING DEVICE AND IMAGE FORMING APPARATUS WITH INTERMEDIATE ROLLER FOR ASSURING EFFICIENT CIRCULATION OF DEVELOPER

BACKGROUND OF THE INVENTION

1. Field of the Invention

The present invention relates to a developing device provided with a developing roller for supplying a developer to a photoconductor, a supply roller for supplying the developer to the developing roller and a restricting member for restricting the amount of the developer supplied onto the supply roller and an image forming apparatus provided with this developing device.

2. Description of the Related Art

Conventionally, an image forming apparatus provided with a developing roller for supplying a toner to a photoconductor, a supply roller for supplying a developer to the developing roller and a restricting member for restricting the amount of the developer supplied onto the supply roller has been used in a color image forming apparatus like the one, for example, disclosed in Japanese Unexamined Patent Publication No. H09-274386.

A developer used for development in such an image forming apparatus tends to reduce the charging performance of carrier because toner components and fine particles adhering to the toner surfaces adhere to the carrier surfaces due to heat and stress.

However, as illustrated in FIG. 3, in the image forming apparatus disclosed in Japanese Unexamined Patent Publication No. H09-274386, a supply roller 7 includes a magnetic pole 9*a* for receiving a developer agitated and conveyed by a second screw 5*b* as being arranged to face the second screw 5*b* and a magnetic pole 9*b* for transferring the developer to a developing roller 11 as being arranged to face the developing roller 11, and a restricting blade 13 is provided as an example of a restricting member for restricting the amount of the developer to be supplied onto the developing roller 11. The supply roller 7 is rotated in a clockwise direction indicated by an arrow Y2, whereby the developer adhering around the supply roller 7 is conveyed from an area facing the second screw 5*b* to an area facing the developing roller 11. The developer supplied onto the developing roller 11 in the facing parts of the supply roller 7 and the developing roller 11 is blocked by the restricting blade 13 so that only a restricted fixed amount of the developer passes the restricting blade 13 to be supplied to the developing area (the area facing the photoconductor). Accordingly, the developer blocked by the restricting blade 13 stays in the vicinity of (upstream in a conveying direction of the developer indicated by an arrow Y1) the restricting blade 13 and the developer is successively supplied from the supply roller 7, wherefore the developer cannot flow anywhere.

Thus, a strong stress is applied onto the developer, which is blocked by the restricting blade 13 due to friction between the developer supplied by the rotations of the supply roller 7 and the developer, and whereby causes the following problems. That is, heat is generated in the part where the developer stays, and toner components and fine particles adhering to toner surfaces adhere to carrier surfaces. Consequently, the performances of the carriers become poorer, which in turn causes a problem of the scattering of the toner. The respective surfaces of the supply roller 7 and the developing roller 11, which face each other, move in opposite directions, and therefore, a strong stress is applied onto the developer held on the supply roller 7 due to friction when the developer passes between the supply roller 7 and the developing roller 11, which further lowers the charging performances of the carrier.

SUMMARY OF THE INVENTION

In view of the foregoing problem associated with the conventional structure, an object of the present invention is to provide an image forming apparatus such as a copier, a facsimile machine or a printer capable of preventing image quality deterioration even if an image forming process is continued for a long time and a developing device usable in such an image forming apparatus.

In order to accomplish the above object, a developing device according to one aspect of the present invention includes: a developing roller arranged to face a photoconductor for forming an electrostatic latent image and adapted to supply a toner to an area facing the photoconductor; an agitating member for agitating a developer; a supply roller that holds the developer agitated by the agitating member, and supplies the toner to an area facing the developing roller; a restricting member for blocking the developer carried on the supply roller and restricting the amount of the developer to be supplied by the supply roller; and an intermediate roller which is provided so as to face the developer being blocked by the restricting member, and includes a first magnetic pole provided so as to face the developer, the first magnetic pole being provided for attracting the developer which stays as being restricted by the restricting member.

According to the foregoing structure, the developer that tends to stay in the vicinity of the restricting member is attracted to the first magnetic pole and conveyed by the rotation of the intermediate roller. Thus, the deterioration of the developer caused by a large amount of the developer staying in the vicinity of the restricting member can be prevented.

These and other objects, features and advantages of the present invention will become more apparent upon a reading of the following detailed description. Further, advantages of the present invention will become more apparent in the following description with reference to accompanying drawings.

DESCRIPTION OF THE PREFERRED EMBODIMENTS

A developing device according to one embodiment of the present invention is described with reference to the accompanying drawings.

On embodiment of the present invention is described below with reference to FIGS. 1 to 4.

Figure 1:
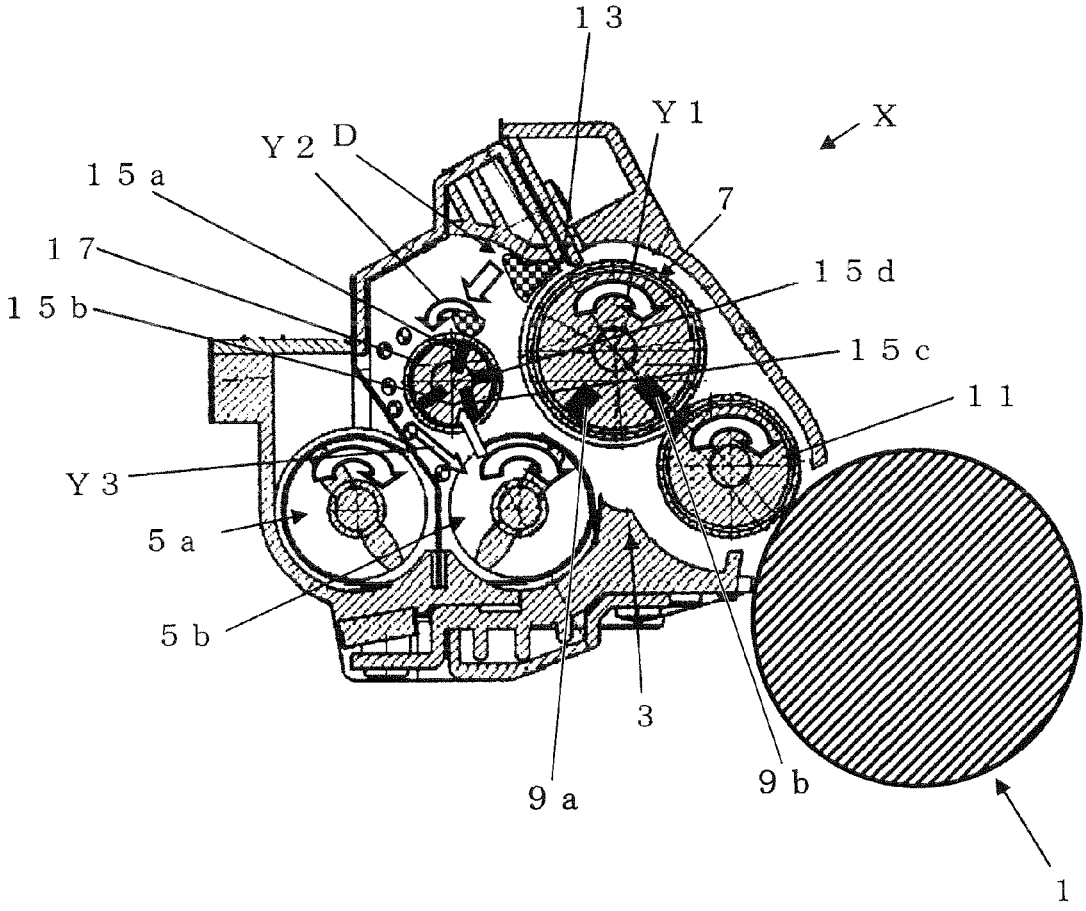
FIG. 1 is a cross-sectional view that shows principal parts of a developing device used in an image forming apparatus according to one embodiment of the invention.
Figure 2A:
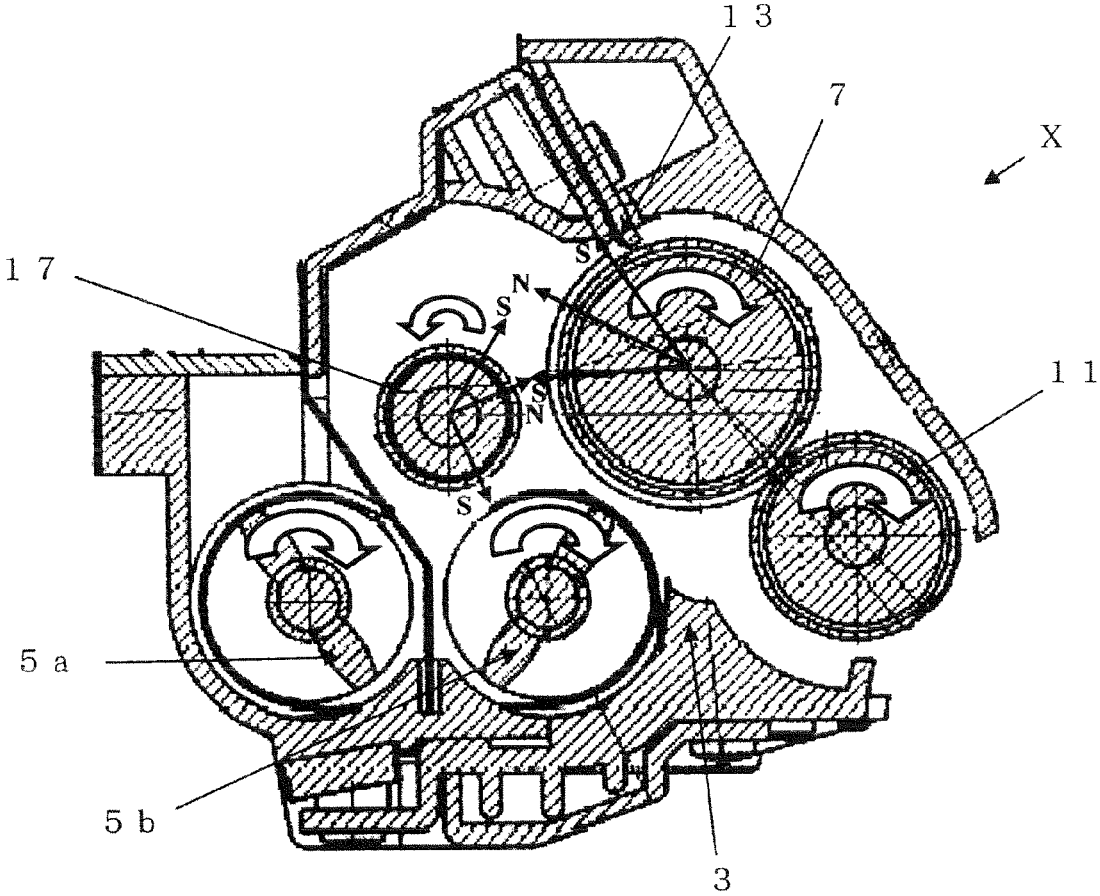
FIG. 2A is a cross-sectional view that shows magnetic poles of the developing device according to the embodiment of the invention.
Figure 2B:
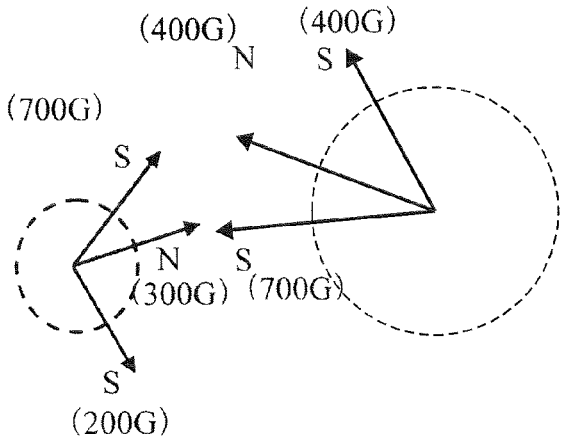
FIG. 2B is a diagram showing the intensities (in gauss) of the respective polarities shown in FIG. 2A.
Figure 3:
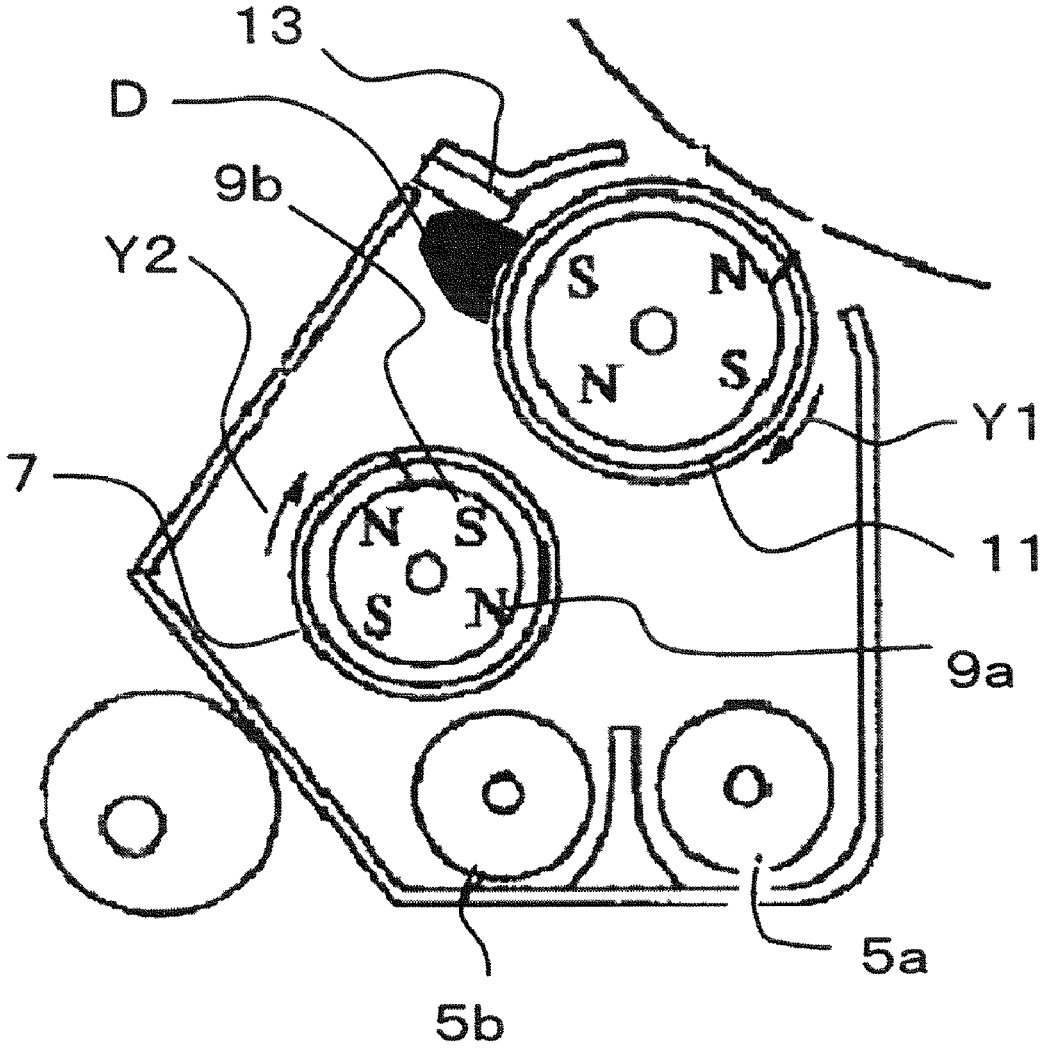
PRIOR ART FIG.3
FIG. 3 is a cross-sectional view of a conventional developing device.
Figure 4:
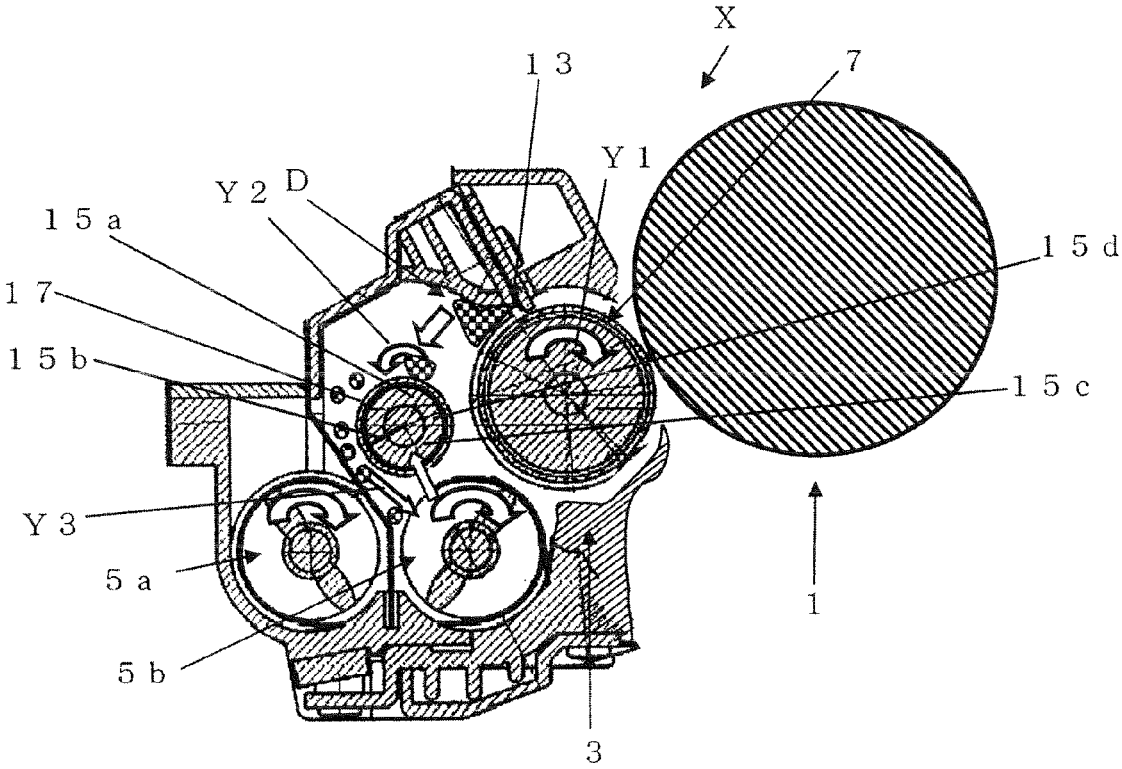
FIG. 4 is a cross-sectional view that shows the developing device according to the embodiment of the invention.

FIG. 1 is a cross-sectional view which shows principal parts of a developing device used in an image forming apparatus according to this embodiment, FIG. 2A is a cross-sectional view which shows magnetic poles of the developing device according to the embodiment of the invention, FIG. 2B is a diagram showing the intensities (in gauss) of the respective polarities shown in FIG. 2A, FIG. 3 is a cross-sectional view of a conventional developing device, and FIG. 4 is a cross-sectional view shows the developing device according to this embodiment.

As shown in FIG. 1, a developing device X according to this embodiment is such that a first screw (as one example of an agitating member) 5*a* for conveying a developer staying at the bottom of a developer tank 3 from a back side toward a front side with respect to a plane of FIG. 1 while agitating this developer and a second screw (as one example of an agitating member) 5*b* for conveying the developer from the front side toward the back side with respect to the plane of FIG. 1 while agitating the developer are provided in the developer tank 3 that is open only in a part where a developing roller 11 faces a photoconductor 1. The developer is conveyed without staying by these first and second screws 5*a*, 5*b* (agitating member, conveying member). The supply roller 7 includes magnetic poles 9*a*, 9*b* inside. The magnetic pole 9*a* is arranged to face the second screw 5*b* and receives the developer being agitated and conveyed by the second screw 5*b*. On the other hand, the magnetic pole 9*b* is arranged to face the developing roller 11 and transfers a toner to the developing roller 11.

The developing device X further includes a restricting blade (restricting member) 13 provided around the supply roller 7 for restricting the amount of the developer to be supplied during the conveyance. Specifically, the developer adhering around the supply roller 7 is conveyed from a position facing the second screw 5*b* to a position facing the developing roller 11 by the rotation of the supply roller 7 in a direction indicated by an arrow Y1 in FIG. 1. During this conveyance, the developer is partly blocked by the restricting blade 13 and only a restricted fixed amount of the developer is supplied to the area facing the developing roller 11.

The developing device X according to this embodiment further includes an intermediate roller 17 arranged to face the staying developer D as being restricted by the restricting blade 13. This intermediate roller 17 includes a first magnetic pole 15*a* for attracting the staying developer D. The intermediate roller 17 is rotated in a direction of an arrow Y2 in FIG. 1. In other words, the intermediate roller 17 is rotated in a direction opposite to the rotating direction (direction of the arrow Y1) of the supply roller 7.

In a conventional developing device as shown in FIG. 3, the developer transferred from the second screw 5*b* is conveyed to the vicinity of the restricting blade 13 by the rotation of the supply roller 7. A part of the developer stays as the developer D and the other part of the developer is supplied to the area facing the developing roller 11 after passing the restricting blade 13. Here, the conventional developing device has no construction for forcibly separating the staying developer D from the vicinity of the restricting blade 13. Thus, there has been a problem that the developer D stays in the vicinity of the restricting blade 13 and is deteriorated with the passage of time.

Accordingly, the developing device of the present embodiment includes the intermediate roller 17 having the first magnetic pole 15*a* for attracting the staying developer D and forcibly separating it from the vicinity of the restricting blade 13 and is arranged to face the restricting blade 13 as described above. Thus, the developer that tends to stay in the vicinity of the restricting blade 13 is attracted to the first magnetic pole 15*a* of the intermediate roller 17. The developer D is conveyed as indicated by arrows Y2 and Y3 in FIG. 1 by the rotation of the intermediate roller 17. The conveyed developer D eventually falls down to the bottom of the developer tank 3 by the action of gravity or by a centrifugal force resulting from the rotation of the intermediate roller 17 and comes to be agitated by the first and second screws 5*a*, 5*b*. In this way, the deterioration of the developer caused by a large amount of the developer staying in the vicinity of the restricting blade 13 can be prevented.

In the present embodiment, attention is focused on a reduction in the staying developer D by attracting the staying developer D as being blocked by the restricting blade 13. However, a transfer route of the developer to the supply roller 7 is not limited to the one from the second screw 5*b* to the supply roller 7 as described. A new transfer route of temporarily transferring the developer from the second screw 5*b* to the intermediate roller 17 and then transferring it from the intermediate roller 17 to the supply roller 7 may be further provided.

As described above, in the case of providing the new transfer route of temporarily transferring the developer from the second screw 5*b* to the intermediate roller 17 and then transferring it from the intermediate roller 17 to the supply roller 7, it is desirable to further provide the intermediate roller 17 with a third magnetic pole 15*c* arranged to face the second screw 5*b* for attracting the developer agitated by the second screw 5*b* and a fourth magnetic pole 15*d* facing the axial center of the supply roller 7 for returning the developer to the supply roller 7.

In this case, the intermediate roller 17 needs to be located at such a position as to face all of the second screw 5*b*, the developer D blocked by the restricting blade 13 and the axial center of the supply roller 7.

Further, in addition to the above embodiment, a second magnetic pole 15*b* having the same polarity as the third magnetic pole 15*c* may be provided. If the second magnetic pole 15*b* is provided, the developer can be more smoothly separated from the intermediate roller 17. In this case, the second screw 5*b* is preferably rotated in a direction from the third magnetic pole toward the second magnetic pole on its surface facing the intermediate roller 17 (FIG. 1). This is because it can be suppressed that the developer separated between the third and second magnetic poles 15*c* and 15*b* respectively is immediately carried on the intermediate roller 17 and supplied to the supply roller 7. Conveying directions of the developer in the longitudinal directions of the first and second screws 5*b*, 5*a* may be set such that the developer can circulate in a circulation path communicating with the opposite ends of the agitating members 5*b*, 5*a*.

FIG. 2A shows directions of the respective magnetic poles by S, N in the construction in which the first magnetic pole 15*a*, the third magnetic pole 15*c* and the fourth magnetic pole 15*d* are arranged as described above. FIG. 2B shows intensities of the respective magnetic poles (in gauss). These data are merely an example and this embodiment is limited to this.

As described, the developing device of the present embodiment is provided with the developing roller 11 that forms a toner thin layer on the surface thereof by holding the toner that flies from the developer held on the supply roller 7. However, the developing roller 11 may be omitted and the supply roller 7 may also function as the developing roller 11 as shown in FIG. 4. In such a case, the photoconductor 1 may be arranged closer to the supply roller 7 to transfer a toner from the supply roller 7 to the photoconductor 1.

It is particularly desirable in view of costs, since either the developing roller 11 or the supply roller 7 can be omitted.

The developing device described in the above embodiment is applicable to an image forming apparatus such as a color or black-and-white copier, a printer, a facsimile machine or a complex machine of these apparatuses.

As described above, a developing device according to one aspect of the present invention comprises a developing roller arranged to face a photoconductor for forming an electrostatic latent image and adapted to supply a toner to an area facing the photoconductor; an agitating member for agitating a developer; a supply roller that holds the developer agitated by the agitating member, and supplies the toner to an area facing the developing roller; a restricting member for blocking the developer carried on the supply roller and restricting the amount of the developer to be supplied by the supply roller; and an intermediate roller which is provided so as to face the developer being blocked by the restricting member, and includes a first magnetic pole provided so as to face the developer, the first magnetic pole being provided for attracting the developer which stays as being restricted by the restricting member.

According to the foregoing structure, the developer that tends to stay in the vicinity of the restricting member is attracted by the first magnetic pole and conveyed by the rotation of the intermediate roller. Thus, the deterioration of the developer caused by a large amount of the developer staying in the vicinity of the restricting member can be prevented.

With the foregoing structure, the intermediate roller preferably further includes a third magnetic pole facing the agitating member for attracting the developer agitated by the agitating member and a fourth magnetic pole facing the axial center of the supply roller for transferring the developer to the supply roller and is arranged at such a position as to face all of the agitating member, the axial center of the supply roller and the developer blocked by the restricting member.

With the foregoing structure, a transfer route of the developer to the supply roller is not limited to the one from the agitating member to the supply roller, and a new route of temporarily transferring the developer from the agitating member to the intermediate roller and then transferring it from the intermediate roller to the supply roller can be provided. Since this causes the developer to be transferred to the supply roller little by little in the respective routes, the developer can be accurately transferred. As a result, image quality can be improved.

With the foregoing structure, the intermediate roller preferably further includes a second magnetic pole having the same polarity as the third magnetic pole and located at a position downstream of the first magnetic pole in a rotating direction of the intermediate roller and before a position facing the agitating member and is located at such a position as to face all of the agitating member, the developer blocked by the restricting member and the axial center of the supply roller.

According to the above construction, it is possible to forcibly return the developer attracted to the intermediate roller to, for example, a developer tank having the agitating member disposed therein between the second and third magnetic poles by the presence of the second magnetic pole. It is therefore possible to prevent such problem that the developer attracted by the restricting member is conveyed to the developing roller again.

With the foregoing structure, it is preferable that the supply roller also functions as the developing roller and is arranged to face the photoconductor.

The foregoing structure of the image forming apparatus is preferable particularly in view of costs, as either one of the supply roller and the developing roller can be omitted.

An image forming apparatus according to the present invention includes the developing member of any one of the foregoing structures of the present invention, and a photoconductor.

According to the foregoing structure, it is possible to realize an image forming apparatus, which is capable of forming quality images for a long period of time by reducing the deterioration in image quality over time to the minimum.

The developing device of the present invention is applicable to an image forming apparatus such as a color or black-and-white copier, a printer, a facsimile machine or a complex machine of these apparatuses.

The specific embodiment or example described in the detailed description of the invention is merely to elucidate the technical contents of the invention and the invention should not be narrowly interpreted by being limited only to such a specific example. Various changes can be made within the gist of the invention and the scope as claimed.

This application is based on Japanese Patent Application No. 2008-008941 filed on Jan. 18, 2008, the contents of which are hereby incorporated by reference.

What is claimed is:

1. A developing device, comprising:

a developing roller arranged to face a photoconductor for forming an electrostatic latent image and adapted to supply a toner to the photoconductor;

an agitating member having at least one screw member for agitating a developer;

a supply roller that holds the developer agitated by the agitating member, and supplies the toner to an area facing the developing roller;

a restricting member for blocking the developer supplied onto the supply roller and restricting the amount of the developer conveyed by the supply roller; and an intermediate roller which is provided in such a manner that a rotational center of said intermediate roller is higher than said agitating member and below a rotational center of the supply roller, and in a top view, a rotational center of said at least one screw member is between the rotational center of the supply roller and the rotational center of the intermediate roller, said intermediate roller is provided to face the developer being blocked by the restricting member, and includes a first magnetic pole provided to face the developer blocked by the restricting member, said first magnetic pole being provided for attracting the developer that is restricted by the restricting member.

2. A developing device according to claim 1, wherein:

the intermediate roller further includes a second magnetic pole provided downstream of the first magnetic pole in a rotating direction of the intermediate roller before a position facing the agitating member for separating the developer from the intermediate roller, the intermediate roller being provided to face both the agitating member and the developer blocked by the restricting member.

3. A developing device according to claim 1, wherein the intermediate roller further includes a third magnetic pole provided to face the agitating member for attracting the developer to the intermediate roller and a fourth magnetic pole provided to face the supply roller for transferring the developer to the supply roller, said intermediate roller being provided to face the agitating member, the axial center of the supply roller and the developer blocked by the restricting member.

4. A developing device according to claim 1, wherein the intermediate rollers further includes a second magnetic pole located at a position downstream of the first magnetic pole in a rotating direction of the intermediate roller and before a position facing the agitating member for separating the developer from the intermediate roller, and is located at a position to face the agitating member, the developer blocked by the restricting member and the axial center of the supply roller.

5. A developing device according to claim 1, wherein a rotational direction of the intermediate roller is opposite to a rotational direction of the supply roller.

6. A developing device, comprising:

an agitating member having at least one screw member for agitating a developer;

a supply roller arranged to face a photoconductor for holding the developer agitated by the agitating member, forming an electrostatic latent image and supplying a toner to the photoconductor;

a restricting member for blocking the developer supplied onto the supply roller and restricting the amount of the developer conveyed by the supply roller; and an intermediate roller provided so that a rotational center of said intermediate roller is higher than the agitating member and below a rotational center of the supply roller, and in a top view, a rotational center of the at least one screw member is between the rotational center of the supply roller and a rotational center of the intermediate roller, the intermediate roller being disposed to face the developer blocked by the restricting member and including a first magnetic pole disposed to face the developer to attract the developer that is restricted by the restricting member.

7. A developing device according to claim 6, wherein a rotational direction of the intermediate roller is opposite to a rotational direction of the supply roller.

8. An image forming apparatus, comprising:

a photoconductor; and a developing roller arranged to face the photoconductor for forming an electrostatic latent image and adapted to supply a toner to the photoconductor;

an agitating member having at least one screw member for agitating a developer;

a supply roller that holds the developer agitated by the agitating member, and supplies the toner to an area facing the developing roller;

a restricting member for blocking the developer supplied onto the supply roller and restricting the amount of the developer conveyed by the supply roller; and an intermediate roller which is provided in such a manner that a rotational center of said intermediate roller is higher than said agitating member and below a rotational center of the supply roller, and in a top view, a rotational center of said at least one screw member is between the rotational center of the supply roller and the rotational center of the intermediate roller, said intermediate roller is provided to face the developer being blocked by the restricting member, and includes a first magnetic pole provided to face the developer blocked by the restricting member, said first magnetic pole being provided for attracting the developer that is restricted by the restricting member.

9. A developing device according to claim 8, wherein the agitating member has a first screw member and a second screw member provided below the intermediate roller, and in a top view, the rotational center of the intermediate roller is between rotational centers of the first and second screw members, and wherein the intermediate roller is driven to rotate so that developer attracted by the first magnetic pole from a vicinity of the restricting member falls onto an area between the first and second screw members in a top view thereof.

10. A developing device according to claim 9, wherein the agitating member has a first screw member and a second screw member provided below with the intermediate roller, and in a top view, a rotational center of the intermediate roller is between rotational centers of the first and second screw members, and wherein the intermediate roller is driven to rotate so that developer attracted by the first magnetic pole from a vicinity of the restricting member falls onto an area between the first and second screw members in a top view.

* * * * *